US011691304B2

(12) United States Patent
Huntt

(10) Patent No.: US 11,691,304 B2
(45) Date of Patent: Jul. 4, 2023

(54) DREADLOCK GROOMING DEVICE

(71) Applicant: Marcus Huntt, Las Vegas, NV (US)

(72) Inventor: Marcus Huntt, Las Vegas, NV (US)

( * ) Notice: Subject to any disclaimer, the term of this patent is extended or adjusted under 35 U.S.C. 154(b) by 0 days.

(21) Appl. No.: 17/391,055

(22) Filed: Aug. 2, 2021

(65) Prior Publication Data

US 2022/0040873 A1 Feb. 10, 2022

Related U.S. Application Data

(60) Provisional application No. 63/103,426, filed on Aug. 6, 2020.

(51) Int. Cl.
*B26B 19/38* (2006.01)
*B26B 19/14* (2006.01)

(52) U.S. Cl.
CPC ..... *B26B 19/386* (2013.01); *B26B 19/145* (2013.01); *B26B 19/3846* (2013.01); *B26B 19/3886* (2013.01)

(58) Field of Classification Search
CPC ..... B26B 15/00; B26B 19/042; B26B 19/046; B26B 19/048; B26B 19/06; B26B 19/063; B26B 19/08; B26B 19/145; B26B 19/16; B26B 19/386; B26B 19/3846; B26B 19/3886
See application file for complete search history.

(56) References Cited

U.S. PATENT DOCUMENTS 2,194,815 A * 3/1940 Testi ..... B26B 19/145 30/346.51
2,241,745 A * 5/1941 Scott ..... B26B 19/16 30/43.2
7,827,695 B1 * 11/2010 Kim ..... B26B 19/06 30/529
10,875,200 B2 * 12/2020 Rolling ..... B26B 21/4031
2004/0045168 A1 * 3/2004 Talavera ..... B26B 19/3813 30/30
2008/0149130 A1 * 6/2008 Brown ..... A45D 8/34 132/279
2014/0283390 A1 * 9/2014 Hall ..... B26B 19/00 132/226
2014/0298660 A1 * 10/2014 Shelemey ..... B26B 19/00 30/133
2019/0184587 A1 * 6/2019 Mount ..... B26B 19/16
2020/0130206 A1 * 4/2020 Niles ..... B26B 19/3853

FOREIGN PATENT DOCUMENTS

WO WO-2008068539 A1 * 6/2008 ..... B26B 19/16
WO WO-2011011613 A1 * 1/2011 ..... B26B 19/06

* cited by examiner

*Primary Examiner* — Evan H Macfarlane
(74) *Attorney, Agent, or Firm* — Invention To Patent Services; Alex Hobson

(57) ABSTRACT

A dreadlock grooming device including handle, a cylindrical housing attached to the handle, a power source, and a power control. The cylindrical housing includes a first-semi-arcuate-section and a second-semi-arcuate-section together forming a clamp of the cylindrical housing. The cylindrical housing includes a plurality of serrated blades positioned along an interior surface of the cylindrical housing provided to remove stray hairs from a section of hair within the clamp formed by the first-semi-arcuate-section and the second-semi-arcuate-section during use.

14 Claims, 5 Drawing Sheets

DREADLOCK GROOMING DEVICE

CROSS-REFERENCE TO RELATED APPLICATION(S)

The present application is related to and claims priority to U.S. Provisional Patent Application Ser. No. 62/103,426 filed Aug. 6, 2020, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of hair styling tools of existing art and more specifically relates to a dreadlock maintaining tool.

RELATED ART

Dreadlocks are a hairstyle wherein long hairs form into matted twisted coils or ropes of hair. Traditional dreadlocks typically form naturally and can vary widely in size and diameter creating an unkempt appearance. Hair stylists can create more evenly sectioned dreadlocks with a neater appearance. However, keeping dreadlocks maintained neatly can be time consuming, frustrating, and even physically strenuous. A common issue with dreadlocks and braids are stray hairs which gives an unkempt look to the style. As a result, there is a strong need for a tool and method to keep dreadlocks looking neat and groomed.

U.S. Pub. No. 2014/0283390 to Cynthia Hall relates to a device for maintaining dreadlocks. The device comprises a housing encasing a motor activated by a controller. A grooming element for encasing the dreadlock is rotatably situated within the housing. The housing comprises a clamping mechanism for securing the device to the dreadlock. Once the dreadlock is secured by the clamping mechanism, the grooming element rotates around the dreadlock to integrate new hair growth into the dreadlock. The grooming element comprises a plurality of trimming components for removing any excess hair that did not integrate into the dreadlock.

SUMMARY OF THE INVENTION

In view of the foregoing disadvantages inherent in the known dreadlock maintaining tool art, the present disclosure provides a novel dreadlock grooming device. The general purpose of the present disclosure, which will be described subsequently in greater detail, is to provide an efficient and effective dreadlock grooming device.

A dreadlock grooming device is disclosed herein. The dreadlock grooming device includes a handle, a cylindrical housing attached to the handle a power source, and a power control. The cylindrical housing includes a first-semi-arcuate-section and a second-semi-arcuate-section together forming a clamp of the cylindrical housing. The power source is configured to supply power to a motor of the dreadlock grooming device. The power control of the dreadlock grooming device is configured to activate the motor of the dreadlock grooming device. The cylindrical housing includes a plurality of serrated blades positioned along an interior surface of the cylindrical housing provided to remove stray hairs from a section of hair within the clamp formed by the first-semi-arcuate-section and the second-semi-arcuate-section during use.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a dreadlock grooming device, constructed and operative according to the teachings of the present disclosure.

The various embodiments of the present invention will hereinafter be described in conjunction with the appended drawings, wherein like designations denote like elements.

DETAILED DESCRIPTION

Figure 1:
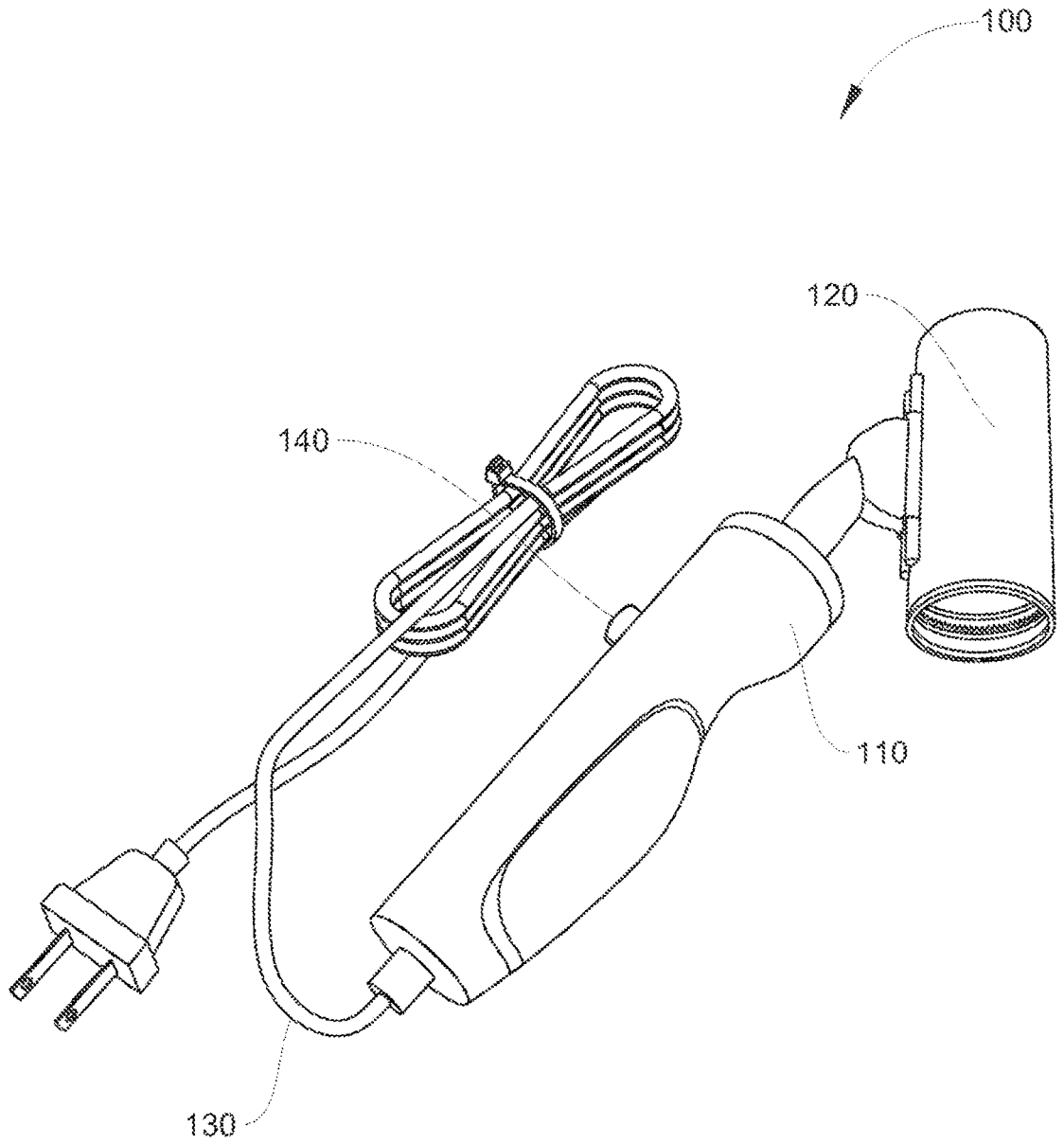
FIG. 1 is a perspective view of the dreadlock grooming device according to an embodiment of the disclosure.

As discussed above, embodiments of the present disclosure relate to a dreadlock maintaining tool and more particularly to a dreadlock grooming device as used to improve the trimming and maintenance of dreadlocks, braids and the like.

Generally, the dreadlock grooming device allows for quick and simple grooming of dreadlocks, braids, box braids, and French braids. The dreadlock grooming device accepts dreadlocks within a cylindrical housing and gently moves a plurality of serrated blades positioned along an interior surface of the cylindrical housing by motor, trimming away any hair that frays away from dreadlocks. The dreadlock grooming device allows frays to be trimmed from dreadlocks in a simpler, faster way.

In a preferred version of the dreadlock grooming device, the dreadlock grooming device includes three (3) serrated blades in a circular band shape. Guard rims are featured on both sides of each blade. The blades mount upon a hosting shaft. The blade-hosting shaft is contained within a hinged cylindrical housing. The hinged cylindrical housing mounts perpendicularly upon a shaft. The aforementioned shaft extends and inserts into a handle, where it mounts within an electric motor. A disc is featured on this lower end of the shaft. Springs extend from a bottom plane of the disc, as do clamp anus. The disc-hosted clamp arms are in alignment with, and attach to, separate clamp arms featured within the base handle. The separate clamp arms are controlled by buttons that are feature on the exterior of the base handle. A power-activation button that initiates the electric motor is also featured on the exterior of the handle. An electric cord for powering the motor extends from the exterior endpoint of the handle.

The dreadlock grooming device can be produced in various sizes and shapes, and may be produced of various applicable materials. The plurality of serrated blades and the cylindrical housing of the dreadlock grooming device may be produced in various diameters. The plurality of serrated blades and the cylindrical housing may be sold separately, and/or a various quantity in various diameters may be included in final packaging. The dreadlock grooming device can be made in variations in which the plurality of serrated blades operate with powered rotation. The dreadlock grooming device may be produced in variations that are powered by direct current batteries, which may or may not be of rechargeable format. The dreadlock grooming device may be made in variations in which the plurality of serrated blades and the cylindrical housing are semi-cylindrical for its use upon other hairstyles, such as but not limited to flat-twist and cornrows.

A method of use may be as follows: a user may lift and extend a strand of dreadlock-fashion hair to be treated. After turning on the dreadlock grooming device the user may then insert the strand within the cylindrical housing. The dreadlock grooming device may then be moved from a base of the strand of hair to a root of the strand of hair. A motorized motion of the dreadlock grooming device when powered will cut any loose hairs that contact the plurality of serrated blades, and leave the rest of the dreadlock looking groomed.

Referring now more specifically to the drawings by numerals of reference, there is shown in FIGS. 1-5, various views of a dreadlock grooming device 100.

FIG. 1 shows a dreadlock grooming device 100 according to an embodiment of the present disclosure. Here, the dreadlock grooming device 100 may be beneficial for use by a user to trim away hair that frays away from dreadlocks, braids and the like. As illustrated, the dreadlock grooming device 100 may include a handle 110, a cylindrical housing 120 attached to the handle 110, a power source 130, and a power control 140.

The cylindrical housing 120 includes a first-semi-arcuate-section 122 and a second-semi-arcuate-section 124 together forming a clamp of the cylindrical housing 120. The power source 130 is configured to supply power to a motor of the dreadlock grooming device 100. The power control 140 of the dreadlock grooming device 100 is configured to activate the motor of the dreadlock grooming device 100. The cylindrical housing 120 includes a plurality of serrated blades 156 positioned along an interior surface of the cylindrical housing 120 provided to remove stray hairs from a section of hair within the clamp formed by the first-semi-arcuate-section 122 and the second-semi-arcuate-section 124 during use. The plurality of serrated blades 156 are motor driven and configured to open and alternatively close and trim stray hairs along a strand of the hair as the cylindrical housing 120 is moved from a base of the section of hair to a root of the section of hair.

Figure 2:
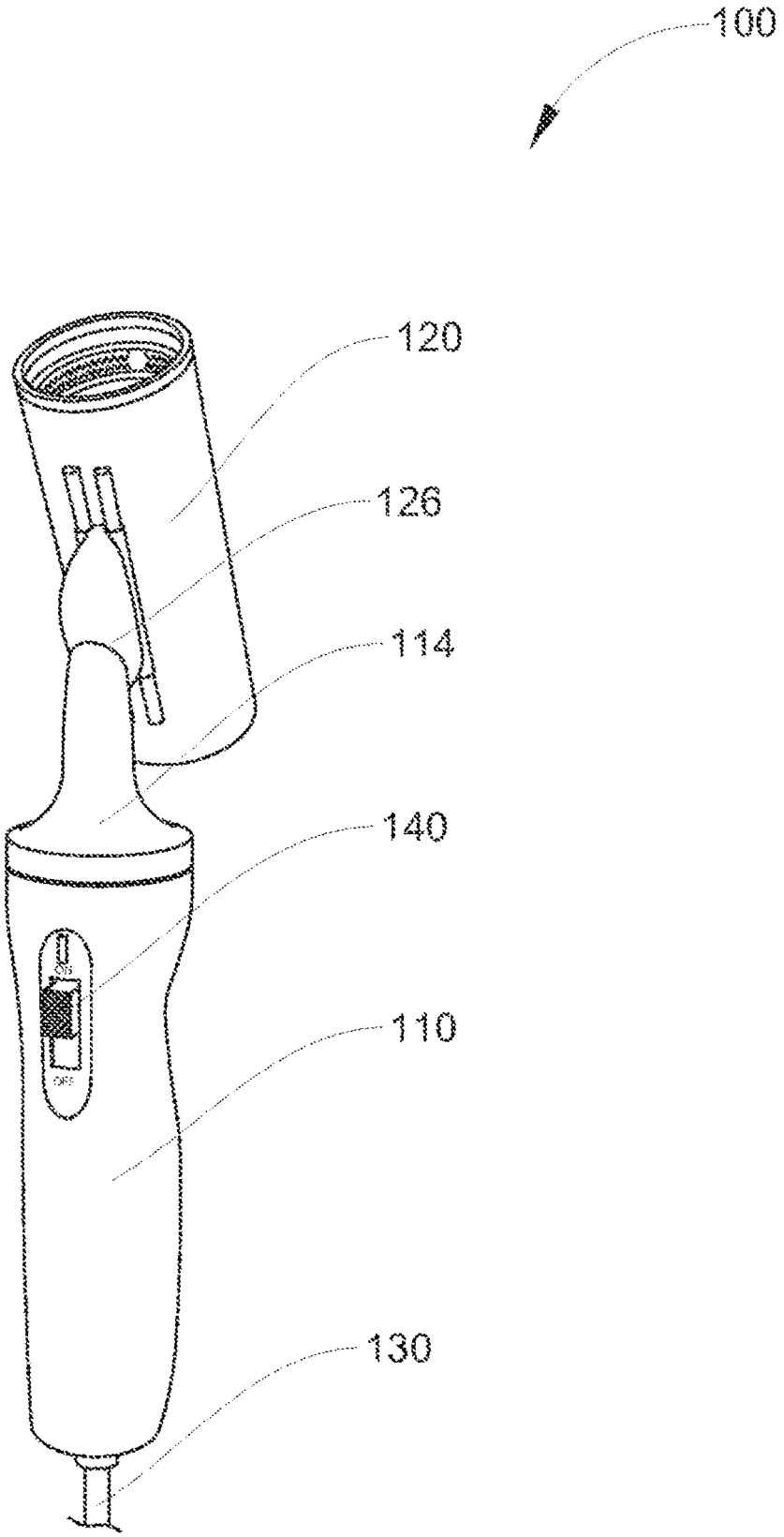
FIG. 2 is a front view of the dreadlock grooming device of FIG. 1, according to an embodiment of the present disclosure.

FIG. 2 shows the dreadlock grooming device 100 of FIG. 1, according to an embodiment of the present disclosure. As above, the dreadlock grooming device 100 may include the handle 110, the cylindrical housing 120 perpendicularly mounted to the handle 110, the power source 130, and the power control 140. The handle 110 is ergonomically shaped and houses a motor 121. The cylindrical housing 120 includes an elongated hollow profile and is sized and configured to receive the section of hair and allow passage of the section of hair therethrough for trimming. The cylindrical housing 120 is attachable to the handle 110 via a mounting shaft 114 extending from the handle 110. The mounting shaft 114 includes a pivot point 126. The power control 140 comprises a switch positioned on the handle 110. The power source 130 includes a power cord provided to supply power to the dreadlock grooming device 100. In certain embodiments, the power source 130 may be a battery-power-source or other suitable rechargeable or non-rechargeable power source 130.

Figure 3:
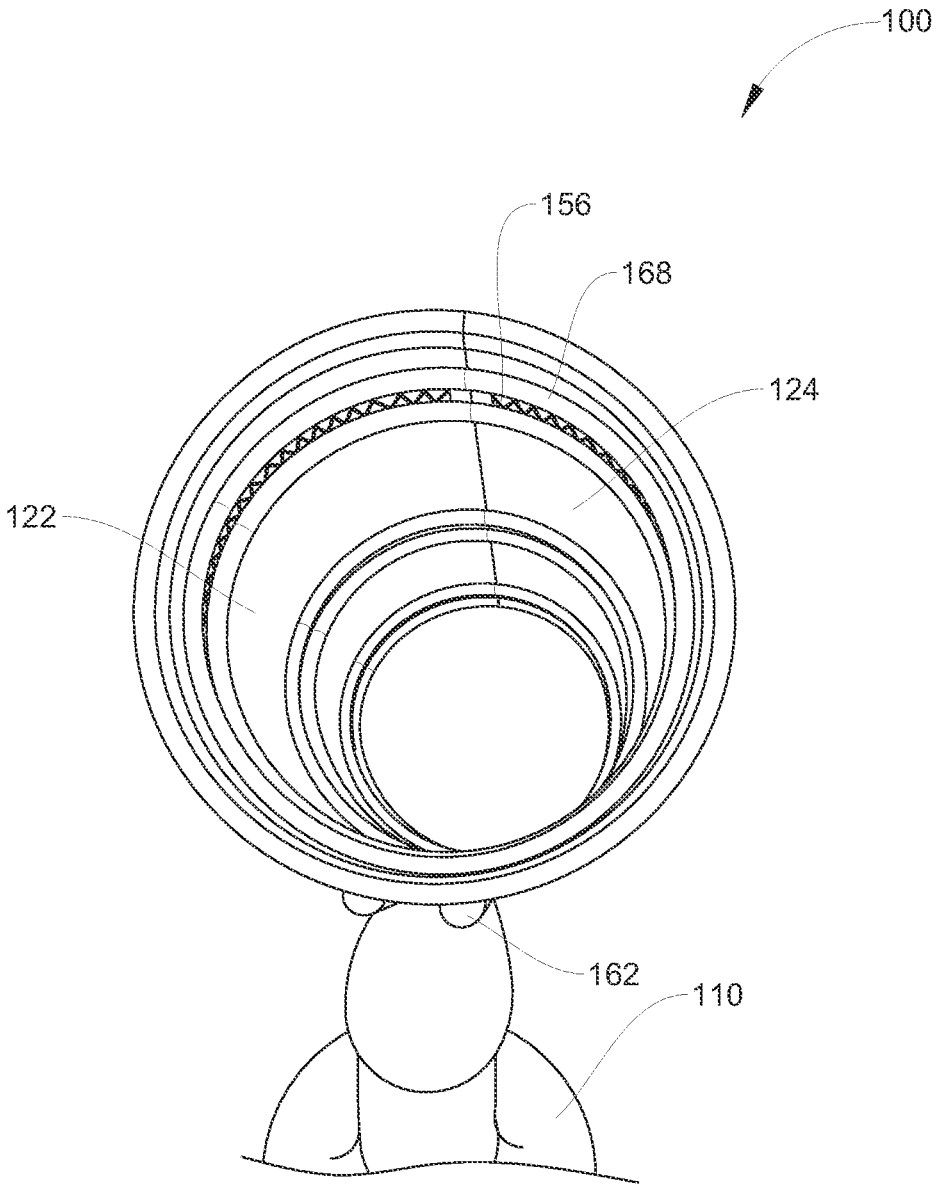
FIG. 3 is an interior perspective view of a cylindrical housing of the dreadlock grooming device of FIG. 1, according to an embodiment of the present disclosure.

FIG. 3 is an interior perspective view of the cylindrical housing 120 of the dreadlock grooming device 100 of FIG. 1, according to an embodiment of the present disclosure. The cylindrical housing 120 is configured to removably receive a section of hair within the clamp formed by the first-semi-arcuate-section 122 and the second-semi-arcuate-section 124.

Figure 4:
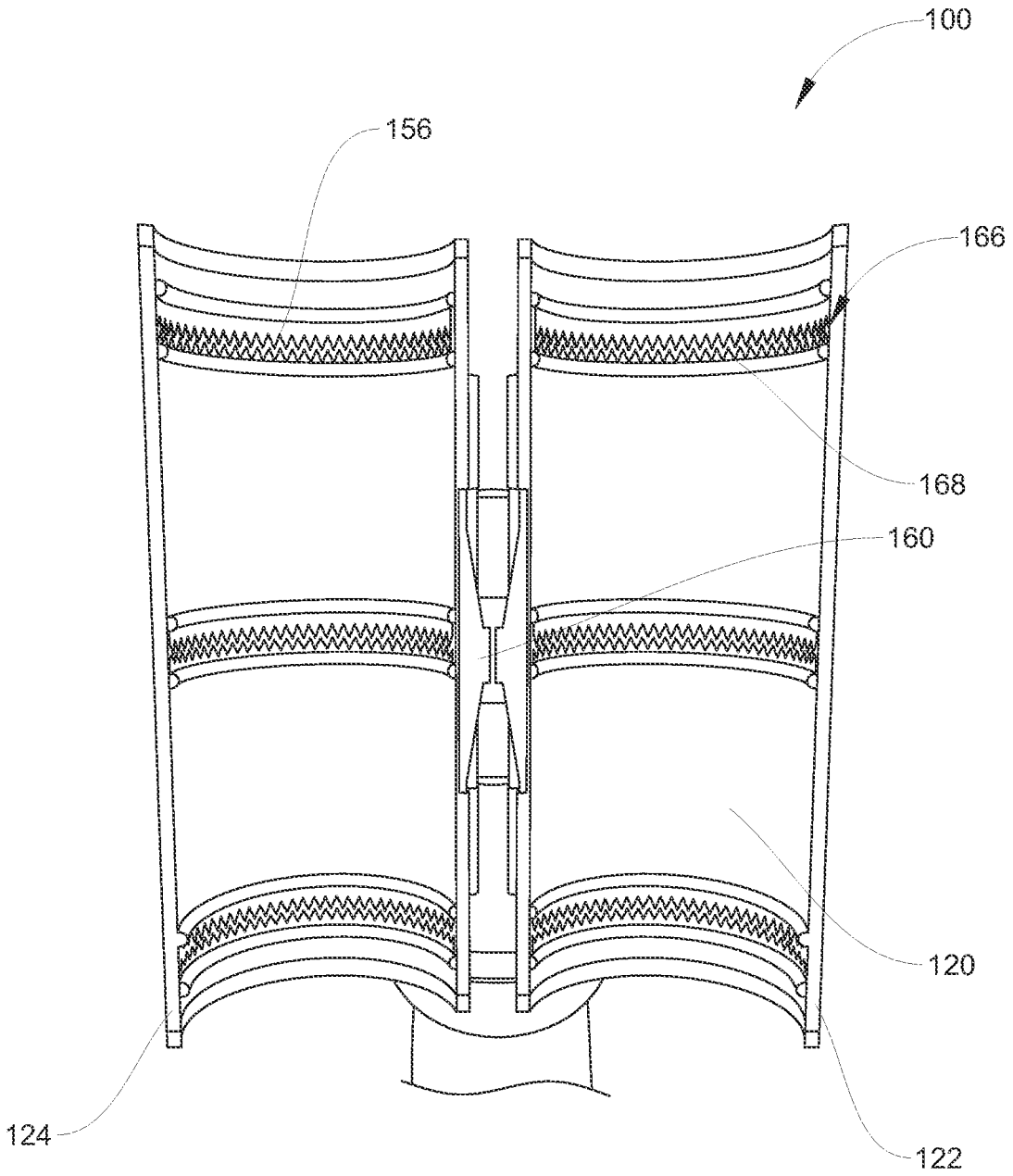
FIG. 4 is an interior perspective view of a cylindrical housing of the dreadlock grooming device of FIG. 1 in an open condition, according to an embodiment of the present disclosure.

FIG. 4 is an interior perspective view of the cylindrical housing 120 of the dreadlock grooming device 100 of FIG. 1 in an open condition, according to an embodiment of the present disclosure. The cylindrical housing 120 is bisected along a length forming the first-semi-arcuate-section 122 and the second-semi-arcuate-section 124 being of equal size. As shown, the first-semi-arcuate-section 122 and the second-semi-arcuate-section 124 are connected at a hinge point 160. The hinge point 160 includes spring loaded hinges 162 configured to maintain closing tension on the cylindrical housing 120. The plurality of serrated blades 156 positioned along the interior surface of the cylindrical housing 120 include a circular band shape. In a preferred embodiment, the plurality of serrated blades 156 includes three serrated blades sections 166. The cylindrical housing 120 further includes guard rims 168 on opposing sides of each one of the plurality of serrated blades 156. The cylindrical housing 120 further includes guard rims 168 on opposing sides of each one of the plurality of serrated blades 156.

Figure 5:
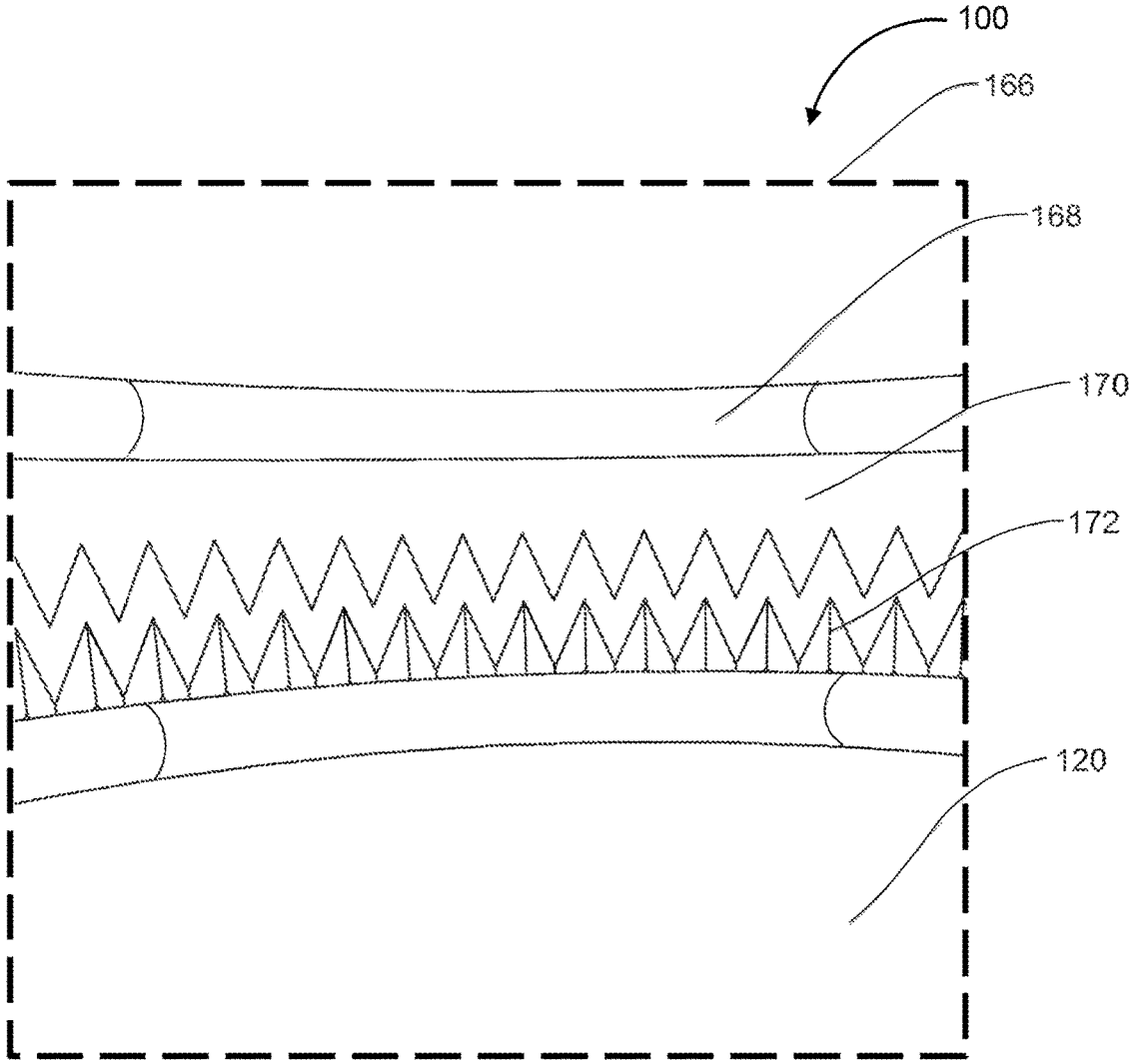
FIG. 5 is a perspective view of a plurality of serrated blades of the dreadlock grooming device of FIG. 1, according to an embodiment of the present disclosure.
Figure 6:
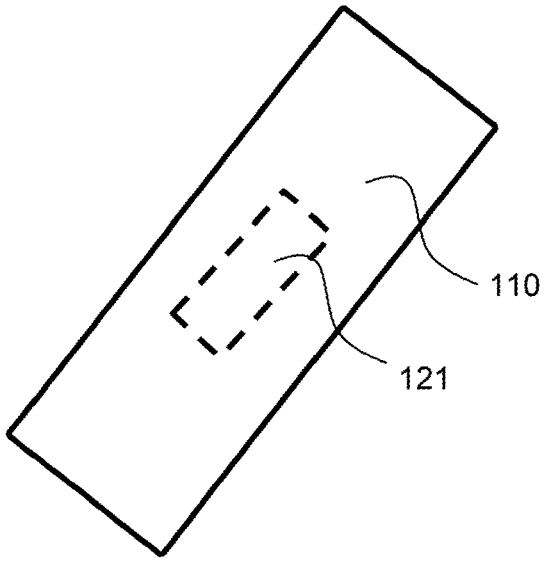
FIG. 6 is a schematic view of a handle including a motor housed within the handle.

As further shown in FIG. 5, each of the serrated blades sections 166 comprise a top-row 170 and a bottom-row 172. The top-row 170 and the bottom-row 172 are configured to mate when in a closed condition. The guard rims 168 extend from the interior surface of the cylindrical housing 120 and form a buffer to prevent direct contact between the section of hair and the plurality of serrated blades 156 allowing for removal of stray the hairs while maintaining a suitable orientation of a remaining portion of the section of hair. In certain embodiments, the plurality of serrated blades 156 operate with powered rotation.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A dreadlock grooming device, the dreadlock grooming device comprising:

a handle, a motor, a cylindrical housing attached to said handle, said cylindrical housing including:

a first-semi-arcuate-section and a second-semi-arcuate-section together forming a clamp of said cylindrical housing, a power source configured to supply power to said motor, and a power control configured to activate said motor wherein said cylindrical housing includes a plurality of serrated blades positioned along an interior surface of said cylindrical housing, said plurality of serrated blades include a circular band shape, wherein said cylindrical housing further includes guard rims on opposing sides of each one of said plurality of serrated blades, wherein said cylindrical housing is configured to removably receive a section of hair within said clamp formed by said first-semi-arcuate-section and said second-semi-arcuate-section, and wherein said plurality of serrated blades are configured to trim stray hairs along said section of hair.

2. The dreadlock grooming device of claim 1, wherein said power control comprises a switch positioned on said handle.

3. The dreadlock grooming device of claim 1, wherein said power source includes a power cord provided to supply power to said dreadlock grooming device.

4. The dreadlock grooming device of claim 1, wherein said handle is ergonomically shaped.

5. The dreadlock grooming device of claim 1, wherein said first-semi-arcuate-section and said second-semi-arcuate-section are connected at a hinge point.

6. The dreadlock grooming device of claim 5, wherein said hinge point includes spring loaded hinges.

7. The dreadlock grooming device of claim 1, wherein said cylindrical housing is attached to said handle via a mounting shaft extending from said handle.

8. The dreadlock grooming device of claim 7, wherein said mounting shaft includes a pivot point.

9. The dreadlock grooming device of claim 1, wherein said cylindrical housing is bisected along a length forming said first-semi-arcuate-section and said second-semi-arcuate-section being of equal size.

10. The dreadlock grooming device of claim 1, wherein said motor is housed within said handle.

11. The dreadlock grooming device of claim 1, wherein said plurality of serrated blades includes three serrated blade sections.

12. The dreadlock grooming device of claim 11, wherein each of said serrated blade sections comprise a top-row and a bottom-row.

13. The dreadlock grooming device of claim 1, wherein said guard rims extend from said interior surface of said cylindrical housing and form a buffer to prevent direct contact between said section of hair and said plurality of serrated blades allowing for removal of said stray hairs.

14. The dreadlock grooming device of claim 1, wherein said cylindrical housing includes an elongated hollow profile and is sized and configured to receive said section of hair and allow passage of said section of hair therethrough for trimming.

* * * * *